United States Patent [19]

Talamantes, Jr.

[11] 4,193,369

[45] Mar. 18, 1980

[54] HIGH SPEED BOAT HULL

[76] Inventor: Carlos Talamantes, Jr., 9915 S. Greenleaf, Santa Fe Springs, Calif. 90670

[21] Appl. No.: 899,180

[22] Filed: Apr. 24, 1978

[51] Int. Cl.[2] ..... B63B 1/00

[52] U.S. Cl. ..... 114/290; 114/56; 114/62

[58] Field of Search ..... 114/56, 61, 62, 63, 114/271, 283, 291, 292, 288, 289

[56] References Cited

U.S. PATENT DOCUMENTS

| | | | |
|---|---|---|---|
| 3,330,239 | 7/1967 | Dornak | 114/56 |
| 3,376,840 | 4/1968 | Zaphiriov | 114/56 |
| 3,776,168 | 12/1973 | Weeks | 114/56 |
| 3,902,445 | 9/1975 | Stolk | 114/62 |
| 3,930,455 | 1/1976 | Bremer | 114/56 |
| 4,022,143 | 5/1977 | Krenzler | 114/56 |

*Primary Examiner*—Charles E. Frankfort
*Assistant Examiner*—D. W. Keen
*Attorney, Agent, or Firm*—Dominick Nardelli

[57] ABSTRACT

A boat hull has a bottom formed with a modified V-shaped longitudinal surface forming the keel and has a tunnel surface disposed on each side of the keel. Both tunnel surfaces have substantially vertical and parallel side surfaces connected by a substantially horizontal surface which is parallel to a base plane in a transverse direction. The outboard side surfaces of each tunnel surface have a transition portion starting aft of the midship section which portion transforms to a respective incline surface at the stern, which surface slopes outwardly and downwardly. The hull also has an outboard flat bottom disposed on each side of the tunnel surfaces. Inboard of each tunnel surface, the modified V-shaped keel has inclined longitudinal surfaces inclining upwards towards the centerline.

10 Claims, 7 Drawing Figures

11
15
30
3
3
24a
23a
13
14
38
37
45
46
42
41
4
4
34a
33a
4a
4a
31
32
23
24
5
5
35
36
33
48
34
47
6
6
21b
21a
25
44
27
30
43
26
29
7
7
12
28

11
15
8
41
38
21
14
30
12

HIGH SPEED BOAT HULL

FIELD OF THE INVENTION

This invention relates to a boat hull and, more particularly, to a hull of the planing type.

BACKGROUND OF THE INVENTION

Flat bottom hulls are considered to have good planing characteristics due to the fact that there is a minimum amount of wetted surface and as a result there is a decrease in drag as the boat speed increases. However, flat bottom hulls lack stability, especially on turning, and also have a tendency to produce a rough ride in choppy water On the other hand, V-bottom hulls, when used for planing, are generally formed with a relatively deep V at the bow which flattens out towards the stern. The V-shaped hull has the ability of being able to cut through heavy seas, although as the V cuts down into the water, the water is displaced along the V and has a tendency to slap against the bottom of the hull. Furthermore, the V bottom hull lacks lateral or rolling stability, particularly in the forward portion of the hull. Therefore the extent of the V in the hull is generally limited to the forward portion and does not extend generally aft of midship.

As an improvement U.S. Pat. No. 3,776,108 teaches a hull which has an overall V-shape with Vs of lesser depth formed on each side of the center line of the keel. This hull increases lateral stability but acts to increase the amount of wetted surface so that the planing characteristics of this hull are adversely affected.

As another improvement, U.S. Pat. No. 3,930,455 teaches a hull which has a pair of upwardly arched longitudinal channels on each side of the keel portion. Although this hull improves the planing characteristics, the hull is subject to capsizing during a relatively high speed type turn.

OBJECTS OF THE INVENTION

An object of this invention is to provide a boat hull which has improved planing characteristics, stability and handling.

Another object of this invention is to provide a hull which captures a pair of columns of air under its hull and gradually laterally releases the columns as the air passes to the stern to increase stability.

Another object of this invention is to provide a shallow V-shaped keel adjacent the stern of the hull, on which the hull can plane.

These and other objects and features of advantage will become more apparent after studying the following description of the preferred embodiment of my invention, together with the appended drawings.

DETAILED DESCRIPTION OF THE DRAWINGS

Figure 1:
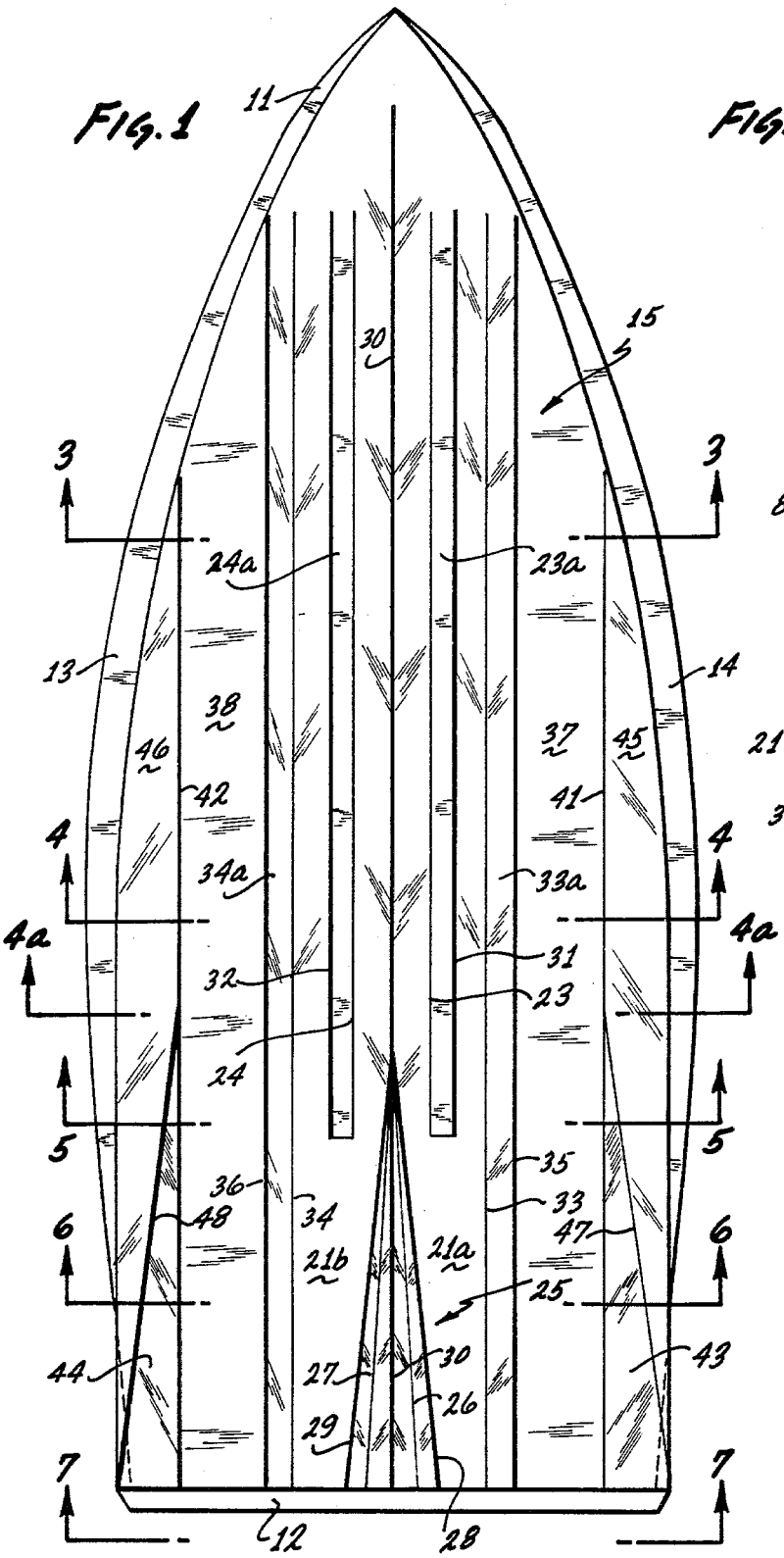
FIG. 1 is a bottom view of my novel boat hull showing the preferred embodiment of my invention.
Figure 2:
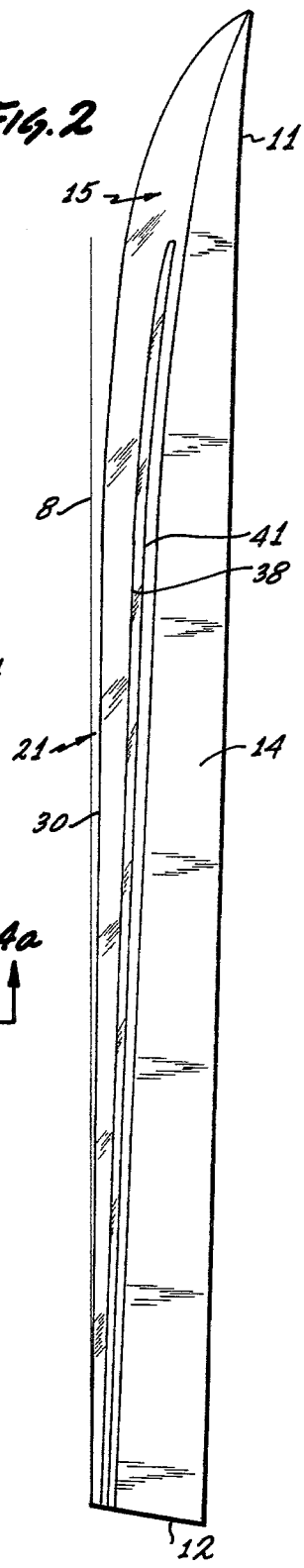
FIG. 2 is a side elevation of the boat hull of FIG. 1.

The drawings illustrate a boat hull which can be preferably formed as a hollow shell by molding reinforced plastic material, such as a mixture of thermosetting resin and glass fibers. In general, the hull is provided with a pointed bow, but could also be curved, and is provided with a generally squared off stern 12. The hull has sloping outboard bulkheads 13 and 14, which curve towards the bow 11 and the stern 12, forming at line 4—4 the widest portion or beam and, as is common in the art, is called the midship section. The bulkheads 13 and 14 are connected with my novel bottom 15. Of course, the hull is symmetrical about a center line 30.

Figure 3:
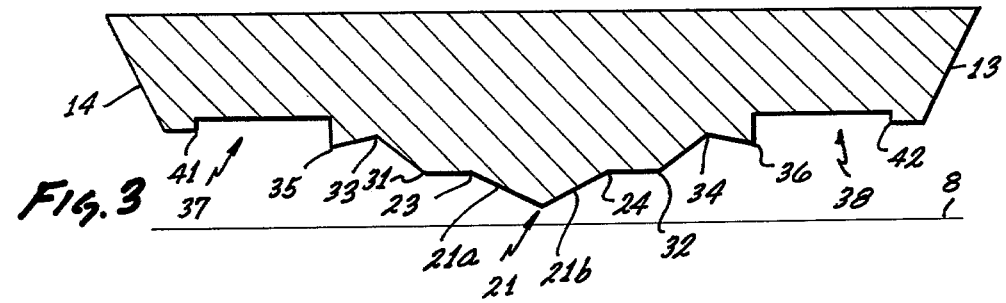
FIG. 3 is a section taken on line 3—3 of FIG. 1.
Figure 4:
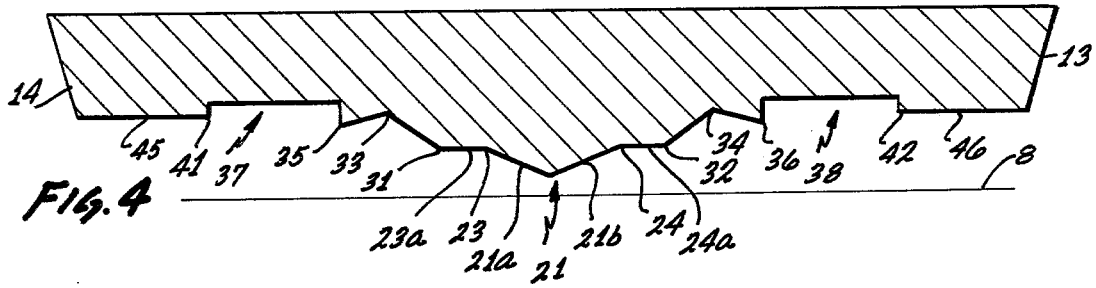
FIG. 4 is a section taken on line 4—4 or line 4*a*—4*a* of FIG. 1 or anywhere therebetween.
Figure 5:
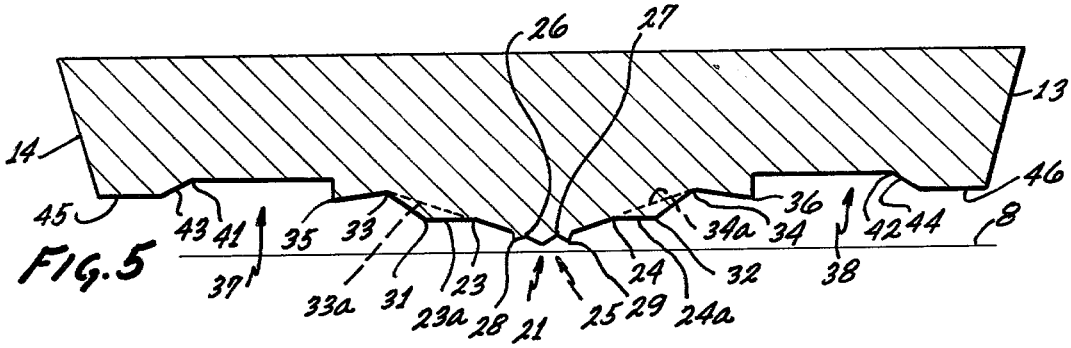
FIG. 5 is a section taken on line 5—5 of FIG. 1.
Figure 6:
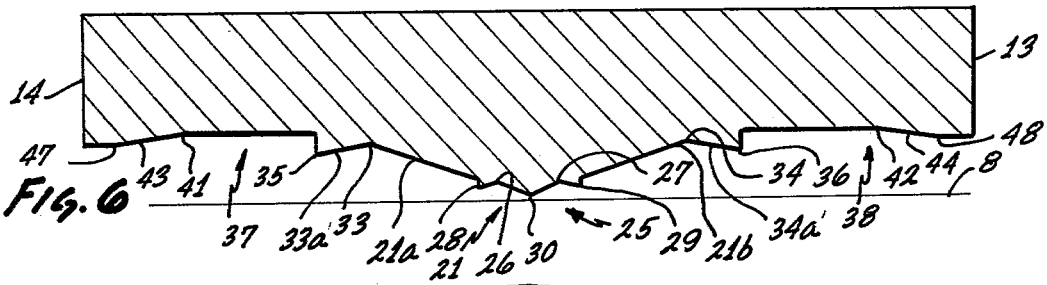
FIG. 6 is a section taken on line 6—6 of FIG. 1.
Figure 7:
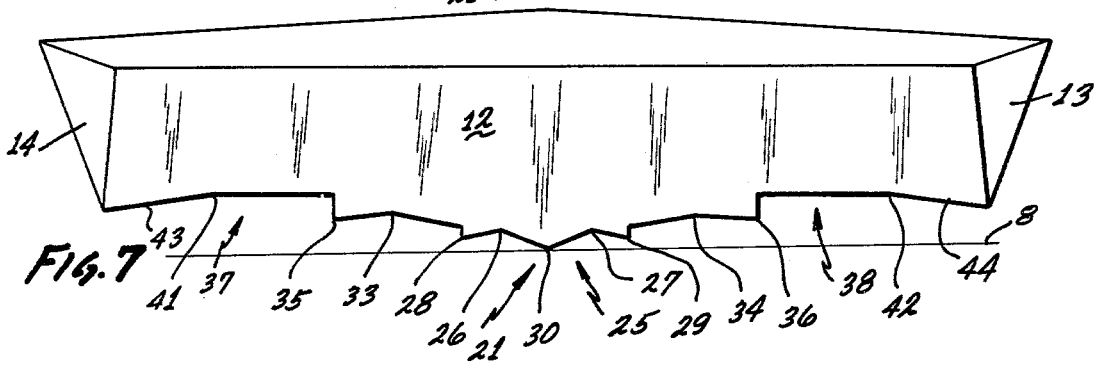
FIG. 7 is an end or stern view of the hull.

In accordance with the invention, the bottom is formed of a complex warped surface having particular features. The bottom having keep portion 21 which, for lack of a better description, is referred to as a modified V having a pair of inclined surfaces 21*a* and 21*b*. From station 4*a*—4*a* (lines 4*a*—4*a*) to the bow 11 the keel has a V shape, as shown in FIGS. 3 and 4. The V shape extends laterally on each side of the center line 30 to lines 23 and 24. Aft of station 4*a*—4*a* of FIG. 1, the keel 21 forms a swept back wing shaped planing surface or appendage 25 as shown in FIGS. 5, 6, and 7. The planing surface 25 starts as a point at station 4*a*—4*a* and widens as it extends aft. At high speeds, I believe the hull makes contact with the water only with the planing surface 25. As shown in FIGS. 5, 6, and 7, the cross-section of surface 25 is preferably gull shaped in that lines 26 and 27 are elevated with respect to lines 28 and 29 which, in turn, are elevated with respect to the center line 30 of the keel. One observes that converging vertical surfaces extend from lines 28 and 29, respectively, to surfaces 21*a* and 21*b*. As an alternate, a flat surface could be used between lines 28 and 30 and lines 29 and 30, making a V shape somewhat shallower than the V shape forward of station 4*a*—4*a*. One will notice that lines 23 and 24 extend from station 5—5 of FIG. 1 to almost the bow where the lines fade into the rounded hull shape formed adjacent the bow. Laterally from each line 23 and 24 extends a surface 23*a* and 24*a* to lines 31 and 32, respectively, which surfaces 23*a* and 24*a* are horizontal in a transverse direction to a base plane represented by lines 8 in the various figures. Aft of station 5—5 the keel portion has its surfaces 21*a* and 21*b* unbroken or smooth to lines 33 and 34. Dash lines 33*a* and 34*a* in FIG. 5 represent this condition. In other words, if one looks forward at section 5—5, one will see the configuration in FIG. 5 represented by the solid lines, and if one looks aft, one will see the configuration represented by the dash lines together with the obvious solid lines. Outboard from lines 33 and 34, respective surfaces 33*a* and 34*a* are formed to lines 35 and 36, which surfaces slope in the outboard direction towards the base plane whereby lines 35 and 36 are lower than respective lines 33 and 34. Outboard of lines 35 and 36, respective tunnels 37 and 38 are formed which have transverse cross-sections that are substantially uniform fore and aft of the hull. In other words, lines 35 and 36 and lines 41 and 42 are substantially parallel to the center line 30. The respective upper surfaces of tunnels 37 and 39 are parallel in a transverse direction to the base plane 8, and almost parallel in the longitudinal direction to base plane 8. The side surfaces of tunnels 37 and 38 are substantially vertically disposed surfaces. However, the outboard vertical surfaces of the respective tunnels aft of station 4a—4a transform to downward sloping surfaces 43 and 44. Outboard surfaces 45 and 46 are horizontal in the transverse direction outboard of lines 41 and 42. Then aft of station 4a—4a, surfaces 43 and 45 cross to form line 47 as surfaces 44 and 46 cross to form line 48.

One observes that the bottom of my novel hull is substantially flat. However, I have provided at the center line a relatively shallow V-shaped keel which transform to a still shallower V-shape in the aft portion. The purpose of this is to reduce further the wetted surface at high speed. I have provided a pair of tunnels 37 and 38 of substantially uniform cross-section fore and aft and having vertical side walls to insure capturing and ramming the air therein, causing the hull to rise quickly as the speed increases. The acute angle, as shown in FIGS. 3, 4, 5, 6, and 7 represented by lines 35 and 36, provide outboard "keels" which contact the water when the hull leans, as in a turn, to help keep it erect. To further prevent the hull from flipping at high speeds, I have provided the sloping surfaces 43 and 44 to relieve the upward force of the air under the hull at the aft end. Since this force is lower, there is less tendency to cause a hull to flip in a tight high-speed turn. I have provided a hull which is more stable and has better control than a flat bottom hull, while still maintaining substantially all of the desirable features of a flat bottom hull. My hull may be used with either an inboard or outboard motor.

Having described the preferred embodiment of my invention one, after reading and studying the above description of the preferred embodiment, can devise other embodiments without departing from the spirit of my invention. Therefore, my invention is to be considered limited only to the scope in the appended following claims.

I claim:

1. A boat hull having a stern and bow and being symmetrical about a center line and having a midship section defined as the largest transverse section, said hull comprising:

a keel portion having a pair of first surfaces forming a V-shape and disposed longitudinally from the stern to the bow;

longitudinally and substantially horizontal outboard second surfaces spaced transversely on opposite sides of said keel portion;

at any transverse plane through the hull, the lines of intersection of each of said second surfaces and said respective plane being horizontal, and the lines of intersection of said keel portion and said respective plane being V-shape and having the point of said respective V-shape line disposed lower than the first named lines of said intersection;

a pair of upwardly arched tunnels connecting said keel portion with each one of said respective second surfaces;

each of said tunnels having a substantially horizontal third surface and a substantially vertically disposed inboard fourth surface which connects to the keel portion, and also having a substantially vertically disposed outboard fifth surface which connects to a respective one of said second surfaces from a first region lying between aft of the bow and forward of the midship section to a second region aft of the midship section, said vertically disposed fourth and fifth surfaces being substantially parallel to each other;

each of said tunnels having an outboard flat inclined sixth surface disposed at an incline and extending longitudinally from said second region to the stern and connecting said horizontal third surface to said respective horizontal second surface.

2. The boat hull of claim 1 wherein:

said keel portion has its V-shape forming a sharper Vee as said keel portion extends from stern to bow;

said keel portion has a wedge shaped appendange depending from the aft portion thereof, which appendage becomes wider as it approaches the stern.

3. The boat hull of claim 2 wherein said wedge shaped appendage has:

a pair of substantially vertically disposed outboard seventh surfaces connected to said keel portion and converging towards said bow;

a V-shaped surface connecting to said seventh surfaces and having a centrally disposed keel line extending lower than said seventh surfaces.

4. The boat hull of claim 3 wherein said appendage further includes:

a pair of inclined eighth surfaces disposed between said V-shaped surface of said appendage and a respective one of said seventh surfaces of said appendage;

each of said inclined eighth surfaces incline upward towards said center line.

5. The boat hull of claim 2 wherein said keel portion is further limited to:

a pair of substantially horizontally disposed ninth surfaces contacting a respective first surface;

said ninth surfaces extending from a region forward of midship section and to a region aft of midship section.

6. The boat hull of claim 2 wherein said keel portion is further limited to a pair of inclined tenth surfaces, each contacting a respective fourth surface and connecting to one of said first surfaces.

7. The boat hull of claim 6 wherein each of said first surfaces of said keel portion forms a substantially horizontally disposed ninth surface extending longitudinally and spaced from said tenth surface and said center line.

8. The boat hull of claim 7, being further limited to wherein:

said keel portion has its V-shape becoming a sharper Vee as said keel portion extends from stern to bow; and said keel portion has a wedge shaped appendage depending from aft portion thereof which appendage becomes wider as it approaches the stern.

9. The boat hull of claim 2 wherein said wedge shaped appendage has:

a pair of substantially vertically disposed outboard seventh surfaces connected to said keel portion and converging toward said bow; and a V-shaped surface connecting to said seventh surface and having a centrally disposed keel line extending lower than said seventh surface.

10. The boat hull of claim 9 wherein said appendage is further includes:

a pair of inclined eighth surfaces disposed between said V-shaped surface and said appendage, and a respective one of said seventh surfaces of said appendages;

each of said inclined eighth surfaces incline upward towards said center line.

* * * * *